US005216846A

United States Patent [19]

Takahashi

[11] Patent Number: 5,216,846

[45] Date of Patent: Jun. 8, 1993

[54] METHOD AND APPARATUS FOR GRINDING FOREMOST END SURFACE OF A FERRULE

[75] Inventor: Mitsuo Takahashi, Matsudo, Japan

[73] Assignee: Seikoh Giken Co., Ltd., Matsudo, Japan

[21] Appl. No.: 883,299

[22] Filed: May 14, 1992

[30] Foreign Application Priority Data

Dec. 17, 1991 [JP] Japan ..... 3-353414

[51] Int. Cl.[5] ..... B24B 1/00

[52] U.S. Cl. ..... 51/326; 51/131.1; 51/125; 51/216 LP

[58] Field of Search ..... 51/326, 125, 216 LP, 51/283 R, 284 R, 328, 131.1

[56] References Cited

U.S. PATENT DOCUMENTS

| | | | |
|---|---|---|---|
| 4,693,035 | 9/1987 | Doyle | 51/284 R |
| 4,831,784 | 5/1989 | Takahashi | 51/131.1 |
| 4,965,415 | 3/1990 | Moulin | 51/216 LP |
| 4,979,334 | 12/1990 | Takahashi | 51/120 |

*Primary Examiner*—Bruce M. Kisliuk
*Assistant Examiner*—Eileen Morgan
*Attorney, Agent, or Firm*—Spencer, Frank & Schneider

[57] ABSTRACT

A method and an apparatus for grinding the foremost end surface of a ferrule integrated with an optical fiber wherein the foremost end surface of the ferrule is stepwise ground together with the optical fiber to exhibit a predetermined radius of curvature. The grinding process is practiced by way of three steps, i.e., a rough grinding step, a medium grinding step and a finish grinding step. A base board and abrasive grains on an abrasive film required for the medium grinding step have a hardness higher than that of those for the rough grinding step, and a base board and abrasive grains on an abrasive film required for the finish grinding step have a hardness higher than that of those for the medium grinding step. The foremost end surface of the ferrule is projected downward of the lower surface of a holder by a predetermined quantity before the rough grinding step is started. In addition, after completion of each grinding operation, the holder is displaced away from the base board so as to allow the latter to be replaced with another one. To assure that the foremost end surface of the ferrule exhibits a predetermined radius of curvature after completion of each grinding operation, it is necessary that each base board is made of an elastic material. A plurality of ferrules can be ground in substantially the same manner.

16 Claims, 5 Drawing Sheets

METHOD AND APPARATUS FOR GRINDING FOREMOST END SURFACE OF A FERRULE

BACKGROUND OF THE INVENTION

1. Field of the Invention

The present invention relates generally to a method and an apparatus for grinding the foremost end of a ferrule integrated with an optical fiber employable for an optical component such as an optical fiber connector or the like to be used for an optical fiber communication circuit system. More particularly, the present invention relates to a method and an apparatus for stepwise grinding the foremost end of a ferrule of the foregoing type at an improved dimensional accuracy with a reduced number of manhours. Further, the present invention relates to a ferrule integrated with an optical fiber wherein the ferrule is produced by employing the method and apparatus constructed according to the present invention.

2. Description of the Related Art

As is well known by any expert in the art, an optical connector has been hitherto extensively used as means for connecting an optical fiber to an exposing optical component in an optical communication circuit network. Usually, the optical connector is produced by way of the steps of inserting an optical fiber through a central hole of a ferrule, fixedly securing the optical fiber to the ferrule with the aid of an adhesive and then grinding and polishing the ferrule together with the optical fiber along their foremost end surfaces.

To reduce loss appearing on the connection surface where the optical fiber is optically connected to the opposing optical component, it has been heretofore required that loss due to reflected light return be minimized. In view of the foregoing requirement, it is advantageously acceptable to grind and polish the foremost end surface of the ferrule while exhibiting a spherical contour having a predetermined radius of curvature. In this connection, a grinding method which creates a ground surface with the ferrule integrated with an optical fiber without light reflection should be considered.

In view of the current circumstance as mentioned above, the inventor has conducted a variety of research and development activities and proposed on various types of grinding methods and grinding apparatuses.

For example, one of the proposals is concerned with a method of grinding the foremost end surface of an optical fiber to exhibit a convex spherical contour wherein a convex spherical surface portion having a predetermined radius of curvature is formed on the lower surface of a circular disc at the central part of the same, an optical fiber is projected downward of the convex spherical surface portion by a predetermined quantity, and the foremost end surface of the optical fiber is rotated about an optical axis of the same while the projected part of the optical fiber is pressed against an abrasive film attached to a soft plate molded of an elastomeric material so as to allow the abrasive film to be warped to assume a concave spherical contour (refer to Japanese Patent Application NO. 91715/1987 filed by the assignee of this invention which is titled "A method of connecting an optical fiber to a certain opponent optical component, an apparatus for grinding an optical fiber to practice the foregoing method and and an apparatus for connecting an optical fiber to a certain opponent optical component").

In addition, another proposal is concerned with an apparatus for simultaneously grinding the foremost end surfaces of a plurality of optical fibers each integrated with an optical fiber with a high grinding quantity to assume a convex spherical contour wherein the ferrules are mounted on a circular disc-shaped jig together with the optical fibers along the circumferential region of the same, a grinding frame is mounted on the central part of the jig so as to adjust the pressure to be imparted to a grinding table having an abrasive film attached thereto, and the grinding frame is then pressed against the grinding table for rubbing the foremost end surfaces of the ferrules with the abrasive film while the jig revolves so as to allow the foremost end surfaces of the ferrules to move along a small circular locus and the grinding table is rotated so as to allow the jig to move along a large circular locus (refer to U.S. Pat. No. 4,831,784 issued May 23, 1989 to the inventor of this invention, which is titled "Polishing apparatus for end surfaces of optical fibers").

According to the latter proposal, the foremost end surfaces of a plurality of ferrules each integrated with an optical fiber can simultaneously be ground at a high efficiency with a high grinding quality.

However, it has been found that the process of turnably displacing the grinding frame has a problem that the quality of the grinding operation varies depending upon on the grinding frame holding position attributable to the foremost end surface of the ferrules, the abrasive film and the grinding direction. To obviate the aforementioned problem, the inventor made a proposal for an improved apparatus for grinding the foremost end surfaces of optical fibers, and U.S. Pat. No. 4,979,334 was issued on Dec. 25, 1990.

According to this proposal, the apparatus is constructed such that the grinding frame is not turnably displaced but the grinding table is rotated so as to allow each ferrule to move along a larger circular locus while the grinding wheel is eccentrically supported. With this construction, the problem associated with the quality of grinding operation which varies dependent on the grinding frame holding position can be solved satisfactorily. In addition, in contrast with the conventional apparatus, there does not arise any malfunction attributable to the displacement of the grinding table as mentioned above. Consequently, a number of ferrules each integrated with an optical fiber can be produced with a high grinding quality.

FIG. 5 is a sectional front view of a grinding apparatus of the foregoing type, particularly illustrating the arrangement of a holder assembly for holding a ferrule integrated with an optical fiber and a grinding table.

A conventional manual grinding operation for grinding the foremost end surface of the ferrule integrated with an optical fiber such as an optical connector or the like will be described below with reference to FIG. 5.

A ferrule 31 having an optical fiber 32 fitted into a central hole thereof is inserted through a fitting hole 34 which is drilled through a circular disc-shaped holder 33 at the central part of the same. A male-threaded portion is formed around a projection 38 extending upward of the holder 33. After the ferrule 31 integrated with the optical fiber 32 (hereinafter referred to simply as a ferrule) is inserted through the fitting hole 34, a flange portion of the ferrule 31 is firmly placed on the upper surface of the projection 38, whereby a reference length H is determined based on the distance through which the ferrule 31 is to be inserted. Then, the ferrule 31 is fixedly mounted on the holder 33 by depressing the flange portion of the ferrule 31 by threadable engagement of a female-threaded portion of an engagement nut 35 with the male-threaded portion of the projection 38.

The reference length H of the ferrule 31 is determined such that the foremost end surface of the ferrule 31 is projected downward of the lower surface of the holder 33 by a quantity of about 0.1 to 0.2 mm.

To grind the foremost end surface of the ferrule 31, an abrasive film 36 is adhesively placed over the upper surface of a base board 37 made of a glass or a synthetic rubber.

Generally, the grinding process is practiced by way of three steps, i.e., a step of coarse grinding with abrasive grains each having a size of about 15 microns, a step of intermediate grinding with abrasive grains each having a size of about 3 microns and a step of finish grinding with grains each having a size of about 0.5 to 1 micron.

The grinding operation is performed by displacing the holder 33 along an arc-shaped locus while the lower surface of the holder 33 is brought into close contact with the working surface of the abrasive film 36.

The first step of coarse grinding is completed when the foremost end surface of the ferrule 31 becomes flush with the lower surface of the holder 33. For this reason, the next step of medium grinding can not be performed any more because the ferrule 31 does not project downward of the lower surface of the holder 33. In other words, the grinding operation can not be performed further unless the holder 33 is replaced with another holder.

To obviate the foregoing difficulty, one set of holders, i.e., three holders each having a different reference length H should be prepared so as to reserve a certain quantity or amount of projection of the ferrule 31 for each grinding operation.

Therefore, to practice the conventional method as mentioned above, it is necessary that after completion of a grinding operation, the present holder be replaced with another holder having a different reference length H which in turn is fitted with the ferrule removed from the present holder, resulting in a complicated grinding process requiring on increased number of manhours.

Especially, in a case in which ten or more ferrules each integrated with an optical fiber are simultaneously mounted on a holder so as to allow the foremost end surfaces of the ferrules to be simultaneously ground, there arises a difficulty in that an error is caused each time the present holder is replaced with another holder, resulting in the quality of the grinding operation being degraded.

SUMMARY OF THE INVENTION

The present invention has been made with the foregoing background in mind.

An object of the present invention is to provide a method of grinding the foremost end surface of a ferrule integrated with an optical fiber wherein once the ferrule is initially mounted on a holder together with the optical fiber, it can be ground stepwise until the finish grinding step without any necessity for replacing the holder with another one during each grinding step.

Another object of the invention is to provide an apparatus for simultaneously grinding the foremost end surfaces of a plurality of ferrules each integrated with an optical fiber by employing the aforementioned method.

A further object of the invention is to provide a ferrule integrated with an optical fiber wherein the ferrule is stepwise ground by employing the method and apparatus mentioned above.

According to a first aspect of the present invention, there is provided a method of grinding the foremost end surface of a ferrule integrated with an optical fiber wherein the foremost end surface of the ferrule is stepwise ground by an abrasive film attached to a base board along an arc-shaped locus on the base board adapted to be rotationally driven by a driving power source while the foremost end surface of the ferrule is pressed against the working surface of the abrasive film, wherein the method comprises a rough grinding step of grinding the foremost end surface of the ferrule using a first base board having a first abrasive film attached thereto; a medium grinding step of grinding the foremost end surface of the ferrule using a second base board having a second abrasive film attached thereto, the second base board having a hardness higher than that of the first base board and the second abrasive film having abrasive grains each having a hardness higher than that of those on the first abrasive film attached thereto; and a finish grinding step of grinding the foremost end surface of the ferrule using a third base board having a third abrasive film attached thereto, the third base board having a hardness higher than that of the second base board and the third abrasive film having abrasive grains each having a hardness higher than that of those on the second abrasive film attached thereto.

To assure that the foremost end surface of the ferrule is reliably stepwise ground together with the optical fiber, it is required that the foremost end surface of the ferrule is normally brought into pressure contact with the working surface of the abrasive film during each grinding operation.

To satisfactorily meet this requirement, the foremost end surface of the ferrule is projected downward of the lower surface of a holder for the ferrule by a predetermined quantity before the coarse grinding step is started.

In addition, to assure that the foremost end surface of the ferrule is reliably stepwise ground to exhibit a predetermined radius of curvature after completion of each grinding operation, it is recommended that the base board be made of an elastic material.

The present invention may equally be applied to a case in which the foremost end surfaces of a plurality of ferrules, each integrated with an optical fiber, are simultaneously ground.

According to a second aspect of the present invention, there is provided an apparatus for grinding the foremost end surface of a ferrule integrated with an optical fiber wherein the foremost end surface of the ferrule is stepwise ground by an abrasive film attached to a base board along an arc-shaped locus on the base board adapted to be rotationally driven by a driving power source while the foremost end surface of the ferrule is pressed against the working surface of the abrasive film, wherein the apparatus comprises a holder on which the ferrule is held together with the optical fiber; a spacer ring made of a wear resistant material, the spacer ring being fixedly secured to the lower surface of the holder; and an arm member for displaceably supporting the holder to displace the holder away from the base board after completion of each grinding operation so as to achieve a series of grinding operations with the base board successively replaced with another one. Specifically, the foregoing series of grinding operations comprises a rough grinding operation for grinding the foremost end surface of the ferrule using a first base board having a first abrasive film attached thereto, a medium grinding operation for grinding the foremost end surface of the ferrule using a second base board having a second abrasive film attached thereto, the second base board having a hardness higher than that of the first base board and the second abrasive film having abrasive grains each having a hardness higher than that of those on the first abrasive film attached thereto, and a finish grinding operation for grinding the foremost end surface of the ferrule using a third base board having a third abrasive film attached thereto, the third base board having a hardness higher than that of the second base board and the third abrasive film having abrasive grains each having a hardness higher than that of those on the second abrasive film attached thereto.

Similar to the method of simultaneously grinding the foremost end surfaces of a plurality of ferrules each integrated with an optical fiber as mentioned above, the present invention may equally be applied to an apparatus for simultaneously grinding the foremost end surfaces of a plurality of ferrules each integrated with an optical fiber with the exception of a holder on which the ferrules are held together with the optical fibers with an arbitrary tilt angle relative to a vertically extending plane with the aid of adaptors each comprising a coupling nut and a projection extending upward of the holder wherein the holder has a spherical bearing incorporated therein so as to enable it to be turnably supported to freely turn within a predetermined angle without any occurrence of rotation.

According to a third embodiment of the present invention, there is provided a ferrule integrated with an optical fiber produced by employing the method according to the first aspect of the present invention, wherein the foremost end surface of the ferrule is stepwise ground together with the optical fiber to exhibit a predetermined radius of curvature.

Further, according to a fourth aspect of the present invention, there is provided a ferrule integrated with an optical fiber produced using the apparatus according to the second aspect of the present invention, wherein the foremost end surface of the ferrule is stepwise ground together with the optical fiber to exhibit a predetermined radius of curvature.

Other objects, features and advantages of the present invention will readily become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will be described in detail hereinafter with reference to the accompanying drawings which illustrate preferred embodiments of the present invention.

Figure 1:
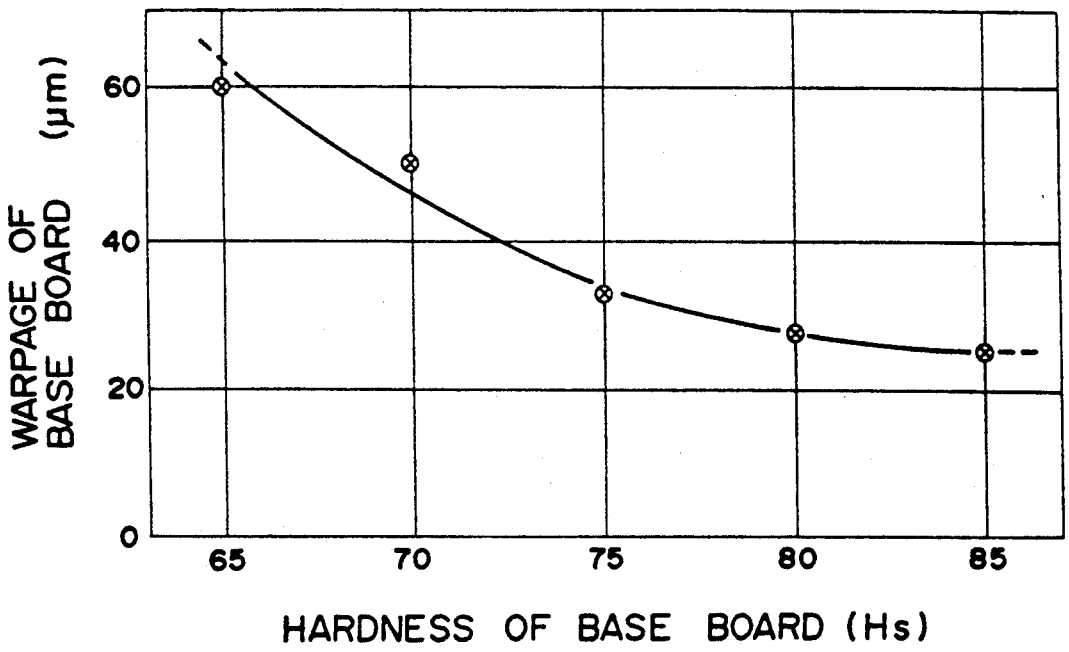
FIG. 1 is a characteristic diagram which illustrates the relationship between the hardness of a base board employable for a grinding apparatus according to the present invention and a quantity of warpage of the base board caused when the foremost end surface of a ferrule is squeezed against the base board of the grinding apparatus.

FIG. 1 is a characteristic diagram which illustrates the relationship between the hardness of a base board employable for a grinding apparatus operable in accordance with a method of the present invention and a quantity of warpage of the base board caused when the foremost end surface of a ferrule integrated with an optical fiber is squeezed against the base board of the grinding apparatus.

In the drawing, the ordinate of the diagram represents the quantity of warpage of the base board in microns unit, and the abscissa represents the hardness of the base board in Shore hardness units Hs. In practice, test conditions were determined such that each ferrule had an outer diameter of 2 mm at the foremost end thereof and a polyvinyl based thermoplastic elastomer was employed as a material for the base board.

As is apparent from the diagram, when the base board had hardness of, e.g., Hs 65, it was warped by a quantity of 60 microns.

Figure 2:
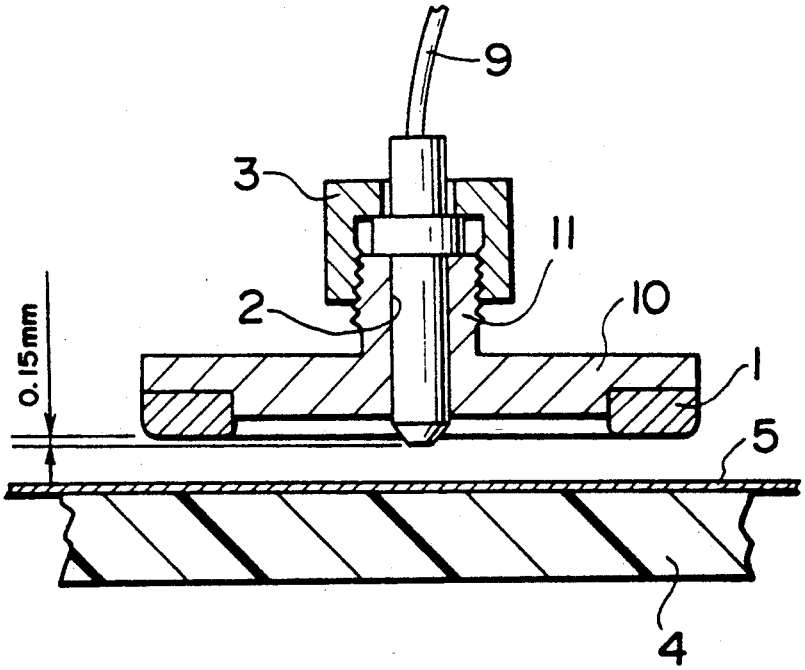
FIG. 2 is a sectional front view which illustrates the structure of a grinding apparatus in accordance with an embodiment of the present invention.

FIG. 2 is a sectional view which illustrates the structure of a grinding apparatus in accordance with an embodiment of the present invention wherein each grinding operation is manually performed with the grinding apparatus.

A ferrule 9 integrated with an optical fiber (hereinafter referred to simply as a ferrule) is inserted through a fitting hole 2 of a circular disc-shaped holder 10 such that a flange portion of the ferrule 9 is immovably placed on the upper end surface of a projection 11 extending upward of the holder 10. Thus, the ferrule 9 is firmly held by the holder 10 via the flange portion thereof by threadably engaging a female-threaded portion of a coupling nut 3 with a male-threaded portion of the projection 11 of the holder 10.

A spacer ring 1 molded of a wear resistant material such as a cemented carbide, alumina or the like is fixedly secured to the lower surface of the holder 10 around the outer circumferential region of the same.

An abrasive film 5 is adhesively placed on a base board 4 of the grinding to form a grinding member and the hardness of the base board 4 selectively determined dependent on the hardness of each abrasive grain and the size of each grain adhesively deposited on the abrasive film 5.

In the shown embodiment, the foremost end of the ferrule 9 is projected downward of the lower surface of the spacer ring 1 by a distance of 0.1 to 0.15 mm to assume a reference dimension H.

Each grinding operation is performed in such a manner that the lower surface of the holder 10 comes in close contact with the upper surface of the abrasive film 5 so as to allow the latter to rub the holder 10 as the base board 4 revolves about its center axis (not shown). Since the quantity of warpage of the base board 4 caused as the foremost end surface of the ferrule 9 is pressed in the downward direction increases in inverse proportion to the hardness of the base board 4 used at this time, the quantity of removal of the foremost end part of the ferrule 9 achieved by the abrasive film 5 inversely decreased.

It should be noted that the grinding apparatus has characteristics such that the absolute value representing the quantity of removal achieved by the grinding operation is kept constant because it is definitely determined by the outer diameter of the ferrule 9, the length of the downward projection of the foremost end surface of the same and the hardness of the base board 4, and that the foregoing quantity of removal is saturated in course of time without any possibility of further increase no matter how long the grinding operation is performed.

Figure 3:
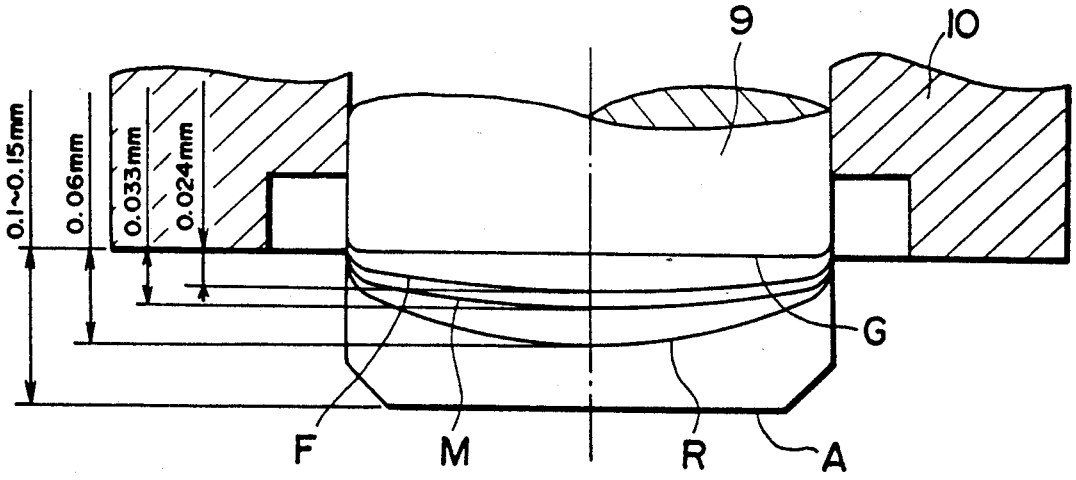
FIG. 3 is an enlarged sectional view of a ferrule ground by employing the grinding method of the present invention, particularly illustrating by way of diagramatical lines a sectional contour of the foremost end surface of the ferrule after completion of each grinding operation.

FIG. 3 is an enlarged sectional view which illustrates by way of example a sectional contour of the ferrule 9 after completion of a grinding operation performed for the foremost end surface of the ferrule 9 in accordance with the grinding procedure as shown in FIG. 2.

A diagramatical line A shows a sectional contour of the ferrule 9 prior to a grinding operation. As is apparent from the diagramatical line A, the foremost end surface of the ferrule 9 is chamfered around the circumferential edge thereof.

A diagramatical line R shows a sectional contour of the foremost end surface of the ferrule 9 after it is ground using a green carborundum abrasive film under conditions such that the base board employed for the rough grinding operation has a hardness of Hs 65 and each abrasive grain has a size of 15 microns. Specifically, the diagramatical line R shows the state wherein the foremost end surface of the ferrule 9 is spherically ground by a quantity of 0.085 mm as measured from the initial position until the part of the ferrule 9 projected downward of the lower surface of the holder 10 assumes a height of 0.06 mm while exhibiting a radius of curvature of about 7.5 mm.

A diagramatical line M shows a sectional contour of the foremost end surface of the ferrule 9 when it is ground using a diamond abrasive film under conditions that the base board employed for the medium grinding operation has a hardness of Hs 70 and each abrasive grain has a size of 3 microns. Specifically, the diagramatical line M shows the state wherein the foremost end surface of the ferrule 9 is spherically ground to assume a height of 0.033 mm while exhibiting a radius of curvature of about 14.3 mm. In this case, a difference of 0.027 mm between the height of 0.06 mm at the time when the foremost end surface of the ferrule 9 is roughly ground and the height of 0.033 mm at the time when the same is intermediately ground represents a quantity of the grinding operation achieved during the medium grinding step.

A diagramatical line F shows a sectional contour of the foremost end surface of the ferrule 9 when it is ground using a diamond abrasive film under conditions that the base board employed for the finish grinding operation has a hardness of Hs 85 and each abrasive grain has a size of 0.024 micron. Specifically, the diagramatical line F shows that the foremost end surface of the ferrule 9 is spherically ground to assume a height of 0.024 mm while exhibiting a radius of curvature of about 22 mm.

A diagramatical line G shows by way of example the case where a glass plate is used as the base board for a finish grinding operation. In this case, the lower end surface of the ferrule 9 is ground to a positional level flush with the lower surface of the holder 10.

As is apparent from the description of the manual grinding operation, when the holder employed for the grinding apparatus holds ten or more ferrules to be ground, it is assumed that the lower surface of the holder is always brought in contact with the upper surface of the abrasive film 5.

Figure 4:
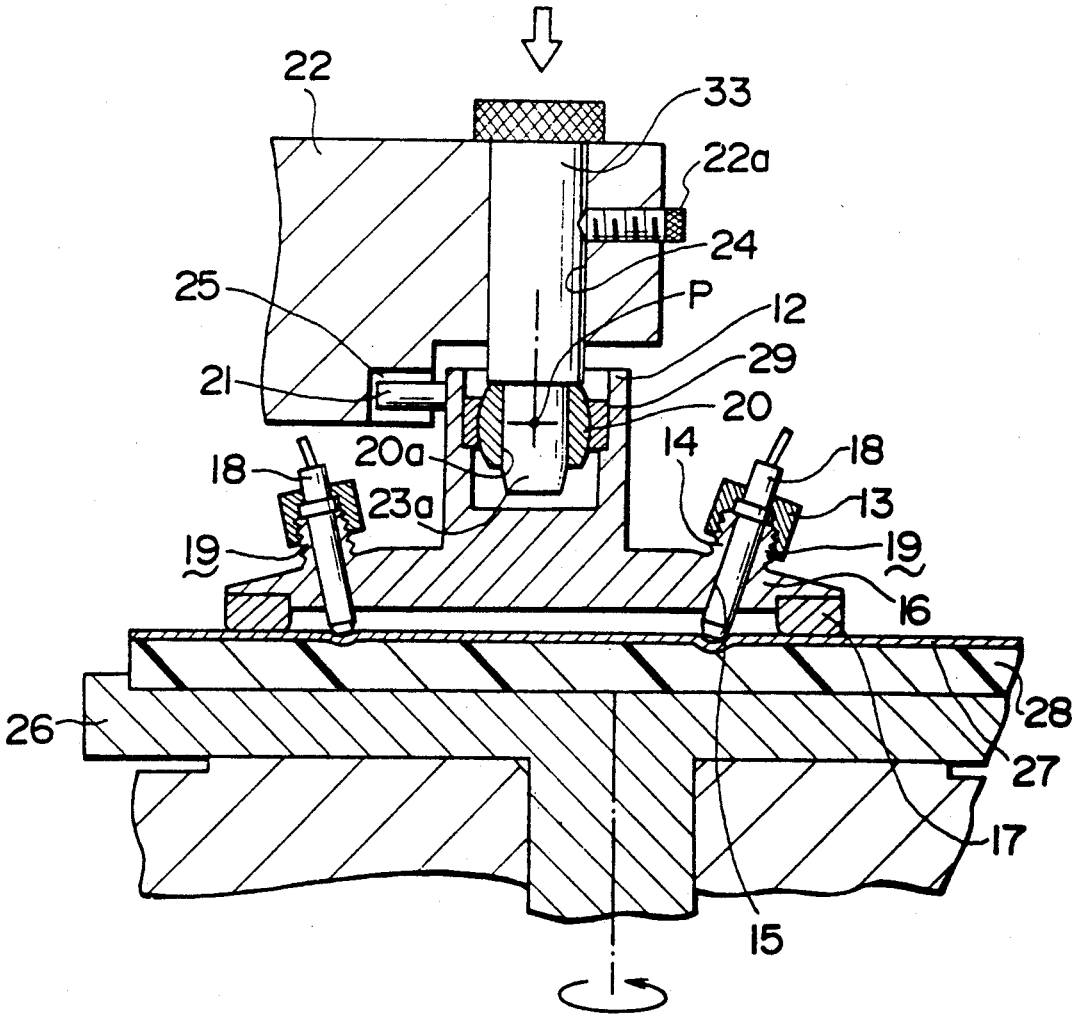
FIG. 4 is a sectional front view which illustrates the structure of a grinding apparatus in accordance with another embodiment of the present invention.

FIG. 4 is a fragmentary sectional view of a grinding apparatus in accordance with another embodiment of the present invention wherein a plurality of ferrules are held on a holder.

Specifically, a spacer ring 17 made of a wear resistant material is integrated with a circular disc-shaped holder 16 around the outer circumferential region of the same. A plurality of through holes 15 are formed through the holder 16 along the circumferential region inside of the spacer ring 17 so as to allow the same number of ferrules 18 to be inserted therethrough. Since a flange portion of each ferrule 18 is immovably placed on the upper surface of a projection 14 extending upward of the holder 16 while the ferrule 18 is inserted into the through hole 15, the quantity of insertion of the ferrule 18 is limitatively restricted. While the foregoing positional state is maintained, a female-threaded portion of a coupling nut 13 is threadably engaged with a male-threaded portion of the projection 14 so as to firmly depress the flange portion of each ferrule 18 with the aid of the coupling nut 13. Thus, a plurality of ferrules 18 can firmly be held on the holder 16 by tightening coupling nuts 13.

With the grinding apparatus constructed in the abovedescribed manner, an adaptor 19 is constructed of the projection 14 and the coupling nut 13.

The foremost end surface of each ferrule 18 is projected downward of the lower surface of the spacer ring 17 by a quantity of 0.1 to 0.5 mm.

A cylindrical holding shaft 12 stands upright at the central part of the holder 16, and a supporting portion 29 for supporting a spherical bearing 20 is arranged around the inner wall of the holding shaft 12.

A through hole 20*a* is formed through the spherical bearing 20 so as to enable the spherical bearing 20 to be turnably held therein and to freely turn relative to the supporting portion 29.

An arm member 22 is fixedly secured to a certain section (not shown) of the grinding apparatus, and a guide hole 24 is drilled through the fore end part of the arm member 22. A holder shaft 33 is inserted through the guide hole 24, and it is then immovably held in the guide hole 24 by tightening a set screw 22*a*. In addition, the fore end part 23*a* of the holding shaft 33 is firmly fitted into the through hole 20*a*.

A groove 25 is formed on the lower side of the fore end part of the arm member 22 so that a pin 21 extending outward of the holding shaft 12 is engaged with the groove 25 so as to prevent the holder 16 from being rotated.

On the other hand, a turntable 26 is rotationally driven by a driving power source (not shown), and a base board 28 having an abrasive film 27 adhesively attached thereto is rotatably placed on the upper surface of the turntable 26. The base board 28 is replaced with a new one each time a grinding operation is completed.

A grinding pressure is imparted to the base board 28 via the holder 16 in the arrow-marked direction by actuating a certain mechanism (not shown). It should be added that a holder assembly comprising the holder 16 and associated components is constructed such that it can be retracted away from the shown operative position located opposite to the base board 28 when the latter is replaced with a new base board.

With such construction, even though the abrasive film 27 is rotated while corrugating in the circumferential direction, a grinding operation can always be performed while the holder 16 is reliably brought into close contact with the abrasive film 27, since the holder 16 can properly follow corrugating movement of the abrasive film 27 as it turns about a central point P of the spherical bearing 20 while it is supported by the spherical bearing 20.

As described above, according to the present invention, a grinding method is practiced by utilizing a phenomenon such that a quantity of warpage of an abrasive film caused by a squeezing force imparted to the foremost end surface of each ferrule varies each time that one of three base boards, each having an abrasive film adhesively attached thereto, is replaced with another base board wherein the hardness of each base board is stepwise increased in accordance with the order of the grinding operations to be performed, i.e., a rough grinding operation, a medium grinding operation and a finish grinding operation.

Figure 5:
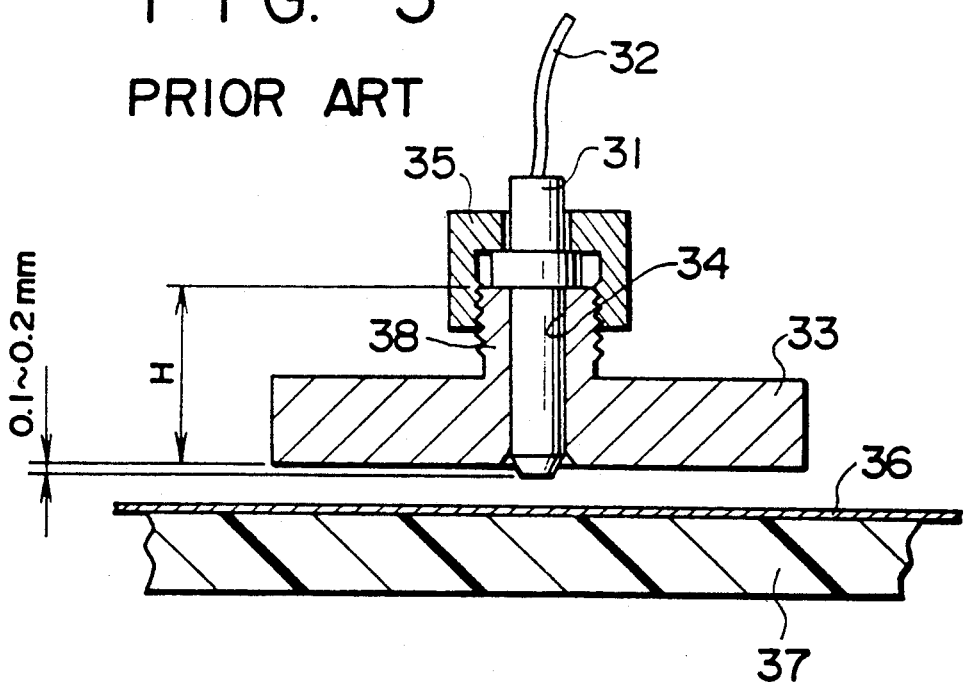
FIG. 5 PRIOR ART
FIG. 5 is a sectional front view of a conventional grinding apparatus including a ferrule holder assembly and a base board, particularly illustrating a method of grinding the foremost end surface of a ferrule integrated with an optical fiber.

Therefore, in contrast with the conventional method as described above with reference to FIG. 5, the method of the present invention does not require either preparation of a plurality of holders each having a different reference height at every grinding step or replacement of the present holder with another one after completion of the preceding grinding operation. In other words, all the grinding operations can be performed with a single holder.

Consequently, the method of the present invention assures that each grinding operation can be performed at an inexpensive tool cost with a reduced number of manhours. Especially, in a case where ten or more ferrules are to be simultaneously ground while they are held on a single holder, a remarkable economical effect can be obtained with the method of the present invention. Another advantageous effect is that the foremost end surface of each optical fiber can stably be ground with a high quality.

While the present invention has been described above only with respect to two preferred embodiments thereof, it should of course be understood that the present invention should not be limited only to these embodiments but various changes or modifications may be made without departure from the scope of the present invention as defined by the appended claims.

What is claimed is:

1. A method of grinding the foremost end surface of a ferrule integrated with an optical fiber wherein the foremost end surface of said ferrule is stepwise ground by an abrasive film attached to a base board along an arc-shaped locus on said base board, said base board being rotationally driven by a driving power source while the foremost end surface of said ferrule is pressed against the working surface of said abrasive film, comprising:

a rough grinding step of grinding the foremost end surface of said ferrule using a first base board having a first abrasive film attached thereto, and a finish grinding step of grinding the foremost end surface of said ferrule using a third base board having a third abrasive film attached thereto, said third base board having a hardness higher than that of said first base board and said third abrasive film having abrasive grains each having a hardness higher than that of those on said first abrasive film attached thereto.

2. The method as claimed in claim 1 further including a medium grinding step of grinding the foremost end surface of said ferrule using a second base board having a second abrasive film attached thereto, said second base board having a hardness higher than that of said first base board and said second abrasive film having abrasive grains each having a hardness higher than that of those on said first abrasive film attached thereto,.

3. The method as claimed in claim 1, wherein the foremost end surface of said ferrule is normally brought into pressure contact with the working surface of said abrasive film during each grinding operation.

4. The method as claimed in claim 1, wherein said ferrule is held on a holder, and the foremost end surface of said ferrule is projected downward of the lower surface of said holder by a predetermined quantity before said rough grinding step is started.

5. The method as claimed in claim 4, wherein said holder is displaced away from said base board so as to allow the latter to be replaced with another base board after completion of each grinding operation.

6. The method as claimed in claim 1, wherein said base board is made of an elastic material, whereby the foremost end surface of said ferrule is ground to exhibit a predetermined radius of curvature after completion of each grinding operation.

7. A ferrule integrated with an optical fiber produced by employing the method as claimed in claim 1, wherein the foremost end surface of said ferrule is ground together with said optical fiber to exhibit a predetermined radius of curvature.

8. A method of simultaneously grinding the foremost end surfaces of a plurality of ferrules each integrated with an optical fiber wherein the foremost end surfaces of said ferrules are stepwise ground by an abrasive film attached to a base board along arc-shaped loci on said base board, said base board being rotationally driven by a driving power source while the foremost surfaces of said ferrules are pressed against the working surface of said abrasive film, comprising:

a rough grinding step of simultaneously grinding the foremost end surfaces of said ferrules using a first base board having a first abrasive film attached thereto, and a finish grinding step of simultaneously grinding the foremost end surfaces of said ferrules using a third base board having a third abrasive film attached thereto, said third base board having a hardness higher than that of said first base board and said third abrasive film having abrasive grains each having a hardness higher than that of those on said first abrasive film attached thereto.

9. The method as claimed in claim 8 further including a medium grinding step of simultaneously grinding the foremost end surfaces of said ferrules using a second base board having a second abrasive film attached thereto, said second base board having a hardness higher than that of said first base board and said second abrasive film having abrasive grains each having a hardness higher than that of those on said first abrasive film attached thereto.

10. An apparatus for grinding the foremost end surface of a ferrule, said ferrule being integrated with an optical fiber, comprising:

a plurality of base boards forming a series thereof, each successive base board in said series having a hardness which is greater than the hardness of a preceding base board;

a plurality of abrasive films comprising a series thereof, each successive abrasive film in said series having grains of a hardness which is greater than the hardness of the grains of a preceding abrasive film, each of said abrasive films being attached to a corresponding base board to provide a series of grinding members comprising base boards of successively increased hardness and attached abrasive films of successively increased hardness;

means for sequentially rotating each grinding member in said series, said grinding members being rotated in the order of increased hardness of the base member and abrasive film thereof;

a holder for supporting said ferrule and optical fiber;

a spacer ring fixedly secured to a lower surface of said holder, said spacer ring being made of wear resistant material; and an arm member for displaceably supporting said holder for moving said holder with respect to each of said grinding members, whereby said arm member sequentially moves said holder and the foremost end of the supported ferrule into contact with a first of said series of rotating grinding members having a first base board of a given hardness and a first abrasive film of a given hardness to perform a rough grinding operation on the end of said ferrule, moves said holder and supported ferrule out of contact with said first grinding member, and moves said holder and the foremost end of said supported ferrule into contact with a second of said series of rotating grinding members having a second base board of a greater hardness than that of said first base board and an abrasive film of greater hardness than that of said first abrasive film to perform a further grinding operation on the end of said ferrule.

11. The apparatus as claimed in claim 10, wherein said arm member brings the foremost end surface of said ferrule into pressure contact with a surface of an abrasive film during each grinding operation.

12. The apparatus as claimed in claim 10, wherein said arm member projects the foremost end surface of said holder downward of a lower surface of said holder by a predetermined amount before said coarse grinding operation is started.

13. The apparatus as claimed in claim 10, wherein said arm member displaces said holder away from a grinding member after each grinding operation to allow that grinding member to be replaced with another grinding member after completion of each grinding operation.

14. The apparatus as claimed in claim 10, wherein said base board is made of an elastic material so as to allow the foremost end of said ferrule to be ground to exhibit a predetermined radius of curvature after completion of each grinding operation.

15. An apparatus for simultaneously grinding the foremost end surfaces of a plurality of ferrules each integrated with an optical fiber comprising:

a plurality of base boards forming a series thereof, each successive base board in said series having a hardness which is greater than the hardness of a preceding base board;

a plurality of abrasive films comprising a series thereof, each successive abrasive film in said series having grains of a hardness which is greater than the hardness of the grains of a preceding abrasive film, each of said abrasive films being attached to a corresponding base board to provide a series of grinding members comprising base boards of successively increased hardness and attached abrasive films of successively increased hardness;

means for sequentially rotating each grinding member, said grinding members being rotated in the order of increased hardness of the base member and abrasive film thereof;

a holder for supporting said ferrules and optical fibers at a tilt angle with respect to a plane perpendicular to said grinding member, each of said holders having a plurality of projections thereon;

a plurality of coupling nuts, each of said nuts securing a ferrule to a projection on said holder;

a spherical bearing incorporated within said holder, said bearing turnably supporting said holder for turning within a predetermined angle without rotation thereof;

a spacer ring fixedly secured to a lower surface of said holder, said spacer ring being made of wear resistant material; and an arm member for displaceably supporting said holder for moving said holder with respect to each of said grinding members, whereby said arm member sequentially moves said holder and the foremost end of said supported ferrules into contact with a first of said series of rotating grinding members having a first base board of a given hardness and a first abrasive film of a given hardness to perform a rough grinding operation on the end of each of said ferrules, moves said holder and supported ferrules out of contact with said first grinding member, moves said holder and the foremost ends of said supported ferrules into contact with a second of said series of rotating grinding members having a second base board of a greater hardness than that of said first base board and an abrasive film of greater hardness than that of said first abrasive film to perform a medium grinding operation on the ends of said ferrules, moves said holder and supported ferrules out of contact with said second grinding member, and moves said holder and the foremost ends of said supported ferrules into contact with a third of said series of rotating grinding members having a third base board of a greater hardness than that of said second base board and an abrasive film of greater hardness than that of said second abrasive film to perform a finish grinding operation on the ends of said ferrules.

16. A method of stepwise grinding the foremost end surface of a ferrule integrated with an optical fiber comprising the steps of supporting said ferrule;

moving the foremost end of said ferrule to a position adjacent a first grinding member comprising a first base board of a predetermined hardness and a first abrasive film attached thereto, said abrasive film being of a predetermined hardness;

rotating said first grinding member;

moving the foremost end of said ferrule into contact with said first abrasive film;

moving the foremost end of said ferrule out of contact with said first abrasive film after the end of said ferrule has received a rough grinding;

substituting a second grinding member for said first grinding member, said second grinding member comprising a second base board of a predetermined hardness and a second abrasive film attached thereto of a predetermined hardness, the hardness of said second base board and of said second abrasive film being greater than that of said first base board and said first abrasive film respectively;

rotating said second grinding member;

moving the foremost end of said ferrule into contact with said second abrasive film;

moving the foremost end of said ferrule out of contact with said second abrasive film after the end of said ferrule has received a medium grinding;

substituting a third grinding member for said second grinding member, said third grinding member comprising a third base board of a predetermined hardness and a third abrasive film attached thereto of a predetermined hardness, the hardness of said third base board and of said third abrasive film being greater than that of said second base board and said second abrasive film respectively;

rotating said third grinding member;

moving the foremost end of said ferrule into contact with said third abrasive film; and moving the foremost end of said ferrule out of contact with said third abrasive film after the end of said ferrule has received a finish grinding.

* * * * *